US006889849B2

(12) United States Patent
Heidel et al.

(10) Patent No.: US 6,889,849 B2
(45) Date of Patent: May 10, 2005

(54) DUAL CASH BOX NOTE AND TICKET VALIDATOR

(75) Inventors: Raymond Heidel, Henderson, NV (US); Akiyoshi Isoi, Las Vegas, NV (US)

(73) Assignee: JCM American Corporation, Las Vegas, NV (US)

( * ) Notice: Subject to any disclaimer, the term of this patent is extended or adjusted under 35 U.S.C. 154(b) by 253 days.

(21) Appl. No.: 10/002,711

(22) Filed: Nov. 1, 2001

(65) Prior Publication Data

US 2003/0080032 A1 May 1, 2003

(51) Int. Cl.[7] ..... G07F 9/06; G07F 17/00; B07C 5/00

(52) U.S. Cl. ..... 209/534; 221/255; 221/277; 700/232; 194/350

(58) Field of Search ..... 209/534, 656, 209/657, 900; 221/255, 277; 700/232; 194/350, 213; 271/181, 279, 303

(56) References Cited

U.S. PATENT DOCUMENTS

| | | | | |
|---|---|---|---|---|
| 4,253,651 A | | 3/1981 | McInerny et al. | 270/58 |
| 4,348,656 A | * | 9/1982 | Gorgone et al. | 209/534 X |
| 4,398,088 A | | 8/1983 | Hirose et al. | 235/379 |
| 4,418,824 A | * | 12/1983 | Gorgone et al. | 209/534 |
| 4,548,353 A | | 10/1985 | Howard et al. | 232/4 R |
| 4,759,448 A | * | 7/1988 | Kawabata | 271/177 X |
| 4,844,446 A | * | 7/1989 | Thie et al. | 271/181 X |
| 4,877,235 A | * | 10/1989 | Robinson et al. | 209/534 X |
| 4,977,502 A | | 12/1990 | Baker et al. | 364/405 |
| 5,420,406 A | * | 5/1995 | Izawa et al. | 235/379 |
| 5,890,440 A | | 4/1999 | Spur | 109/47 |
| 5,907,141 A | | 5/1999 | Deaville et al. | 235/375 |
| 6,012,564 A | | 1/2000 | Mukai | 194/206 |
| 6,014,594 A | | 1/2000 | Heidel et al. | 700/231 |
| 6,021,883 A | | 2/2000 | Casanova et al. | 194/217 |
| 6,059,090 A | | 5/2000 | Davis et al. | 194/350 |
| 6,125,307 A | | 9/2000 | Heidel et al. | 700/232 |
| 6,128,550 A | | 10/2000 | Heidel et al. | 700/232 |
| 6,170,818 B1 | | 1/2001 | Eastman et al. | 271/184 |
| 6,241,069 B1 | | 6/2001 | Mazur et al. | 194/207 |
| 6,264,556 B1 | | 7/2001 | Izawa et al. | 463/25 |

FOREIGN PATENT DOCUMENTS

| | | |
|---|---|---|
| EP | 0675465 | 10/1995 |
| WO | WO 98/47100 | 10/1998 |
| WO | WO 01/22314 | 3/2001 |

* cited by examiner

*Primary Examiner*—Donald P. Walsh
*Assistant Examiner*—Jonathan R Miller
(74) *Attorney, Agent, or Firm*—David B. Abel; Squire, Sanders & Dempsey

(57) ABSTRACT

A bill acceptor system for accepting bills, vouchers, scrip, tickets and/or currency into an electronic gaming machine or alternative type of customer service device. The system includes a validator assembly capable of identifying acceptable notes and discriminating between currency and non-currency notes. The system also includes a transport assembly for transporting notes from the validator to a dual section cash box. The dual section cash box is configured to receive and hold notes received from the bill acceptor in different compartments.

36 Claims, 4 Drawing Sheets

DUAL CASH BOX NOTE AND TICKET VALIDATOR

BACKGROUND OF THE INVENTION

1. Field of the Invention

The present invention relates to a currency and ticket validator apparatus that can automatically separate currency from non-currency and store each in a separate compartment of a dual section cash box for intended use in electronic gaming machines, vending machines and the like.

2. General Background and State of the Art

In the early 1990's there was a fundamental change in the performance and capability of gaming machines initiated by the incorporation of bill acceptors into such machines. Bill acceptors are devices which receive paper currency ("currency") and, using a validator having both hardware and software components, the received currency is scanned with a variety of sensors and the sensor information is analyzed to determine (1) authenticity and (2) denomination of the currency from the scanned data. If the scanned currency is determined to be authentic currency, e.g. a United States $1, $5, $10, $20, $50 or $100 bill or other legal tender currency, it is transported to a cash box within the bill acceptor for storage.

Based upon the denomination of the accepted currency, a signal is sent from the validator to the host machine's controller or processor to cause the machine to accumulate a corresponding amount of credits within the machine's credit meter representing the cash value or credits available for purchasing products or wagering, in the case of a gaming machine. As the user purchases products from or plays the machine, the purchase price or wager is debited from the credit meter. In the case of a gaming machine, wins are either accumulated as credits or paid out in coins. Acceptors of this type are known and are discussed for example in U.S. Pat. No. 5,863,039 issued Jan. 26, 1999 to Suzuki.

Until recently, gaming machines paid out all winnings in coins. This disadvantaged both the player and the casino. First, if the hopper did not have enough coins to pay out the winnings, the machine locked up and remained so until an authorized person reset it. This reduced the amount of time that a machine was in play, resulting in lost business to the casino. Second, the player had to wait for the casino to reset the machine and manually "hand-pay" the player the winnings before the player could start playing on that machine again. Addressing both concerns, a second generation bill acceptor has been developed which can store paper currency and can function as a "recycler" of currency, accepting any type of currency from a customer and returning for payouts a selected denomination of currency to the customer. Machines using these new validators can pay out larger winnings in combinations of paper currency and coins without locking up and requiring a hand-pay. However, not all casinos have chosen to utilize the recycling feature of these new bill acceptors in all of their machines. To achieve similar goals, some casinos are contemplating the use of non-currency tickets unique to the casino.

Casinos are introducing such tickets or coupons to increase the retention rates and make the machines more self-sufficient. The tickets substitute as cash within the casino and on most other gaming machines in that casino. When a player wins a large sum of money, the machine will return tickets printed in various denominations, supplemented by coins, to equal the amount of winnings. The player can exchange the ticket for cash at a cashier's window or use the ticket in other machines in that casino. Because the gaming machines may also be able to print the tickets if necessary, the need for human resources is further limited. Casinos have benefitted from increased player retention as a result of the use of non-currency tickets.

Casinos that use these tickets, however, are facing problems integrating the tickets into their current counting systems. Generally, gaming machines store the valid tickets along with the valid paper currency in a single hopper or note box. As needed, casino staff will replace the note box filled with tickets and currency with an empty note box. The filled note box is taken to a counting room where the note box's contents are counted and sorted. The cash counting and sorting equipment in the counting rooms are limited to counting and sorting a maximum of six different "notes." This limits, for example, the counting machine to separately stacking the $1, $5, $10, $20, $50, and $100 bills. Tickets, a seventh type of note accepted by the second generation types of validators, are thus counted and sorted as "suspect notes" by the sorting equipment. In general, a "suspect notes" classification was created primarily to separate out counterfeit currency. Because the sorting machines are not designed to handle a large volume of suspect notes, the suspect notes bin of the counting machine was made comparatively small. As a result, when tickets are incorporated as an accepted currency, the suspect notes bin fills up very quickly. This slows down the reconciliation process.

Accordingly, a system allowing continuous play and rapid counting and sorting would be beneficial to the gaming industry. A change in the method of ticket collection and sorting in the gaming machine would ensure that the operations in the counting and sorting room are not affected. Other devices such as vending machines and pay-point service stations having bill and ticket acceptors can suffer the same problems of increased cost to manually separate out the tickets from the currency when the money in the note box is counted and separated. All these devices could benefit from an improved separator mechanism within the validator assembly and a dual storage note and ticket hopper system.

The above described and many other features and attendant advantages of the present invention will become apparent from a consideration of the following detailed description in conjunction with the accompanying drawings.

SUMMARY OF THE INVENTION

The present invention is directed to a bill acceptor and a method for its operation. Due to the expansion of the types of acceptable paper which are accepted by the bill acceptor placed in gaming machines, bills, vouchers, script, tickets, and currency will be hereinafter collectively referred to as "notes." The bill acceptor of the present invention is adapted to provide for a more efficient way to integrate non-currency notes, such as tickets, bills, vouchers and script (collectively "tickets") into the circulation of currency. The bill acceptor discriminates tickets from currency and then directs the currency and the tickets to different hoppers which can be accommodated by the counters and sorters in the counting rooms of a casino or other establishment. Accordingly, a bill acceptor system for accepting and separating tickets and currency in an electronic gaming machine or alternative type of customer service device is set forth which includes a validator assembly to be mounted in or on the machine, the validator assembly having a currency and ticket discriminator to sense the authenticity, denomination, amount and type of the currency or ticket passing through and issue a signal corresponding to the currency or ticket type to the transportation assembly. The transportation assembly contains a deflector that can move into one of at least two positions depending on the signal received. A cash box with two sections is provided to receive deposited currency and tickets into either the bill hopper or the ticket hopper.

When a player inserts a note into a bill acceptor of the present invention, the discriminator determines whether the note is a ticket or currency. The discriminator sends a signal to both the interface with the machine for the accumulation of a corresponding amount of credits and to the transportation assembly to guide the note into the proper hopper. Upon receiving the signal, the drive mechanism in the transportation assembly switches the deflector into the proper position, depending on whether the validator received currency or a ticket. In a first embodiment, the deflector has two positions that can guide the note into either the bill hopper or the ticket hopper. Once the note is inside either hopper, a spring loaded mechanism keeps all notes tightly pressed against one another to allow an orderly and efficient stacking of the notes.

The above described and many other features and attendant advantages of the present invention will become apparent from a consideration of the following detailed description in conjunction with the accompanying drawings.

BRIEF DESCRIPTION OF THE DRAWINGS

A detailed description of the invention will be made with reference to the accompanying drawings wherein.

DETAILED DESCRIPTION OF THE PREFERRED EMBODIMENTS

Figure 1:
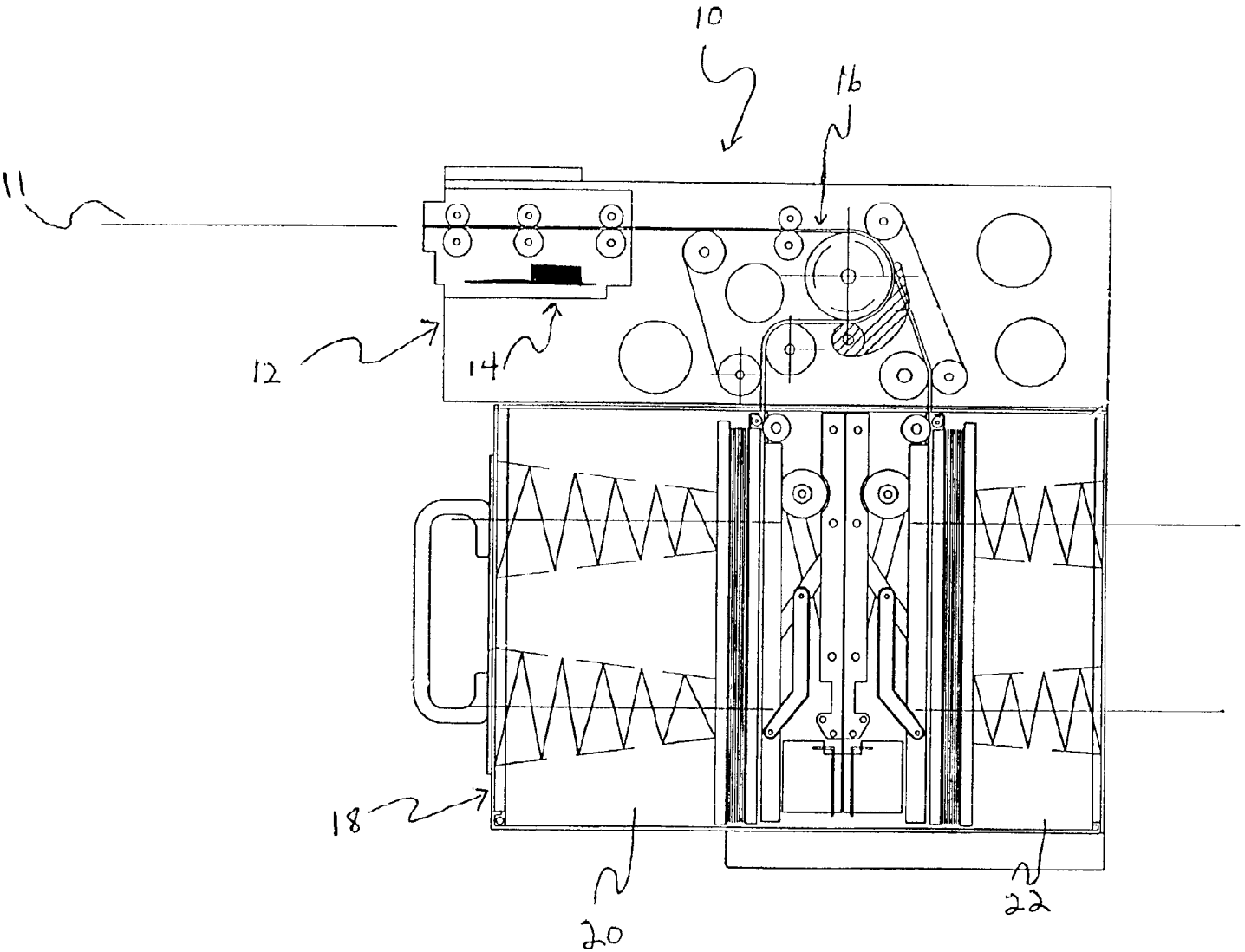
FIG. 1 is a cross-sectional view of a bill acceptor including a validator assembly and a dual section cash box according to the present invention.

FIG. 1 shows a bill acceptor 10 with a validator assembly 12 and a dual section cash box 18 according to the present invention. The validator assembly 12 contains a note discriminator 14 and a transportation assembly 16. The present exemplary embodiment of the bill acceptor 10 is for casino gaming machines, such as slot machines, video slot or poker machines, video keno machines and the like. The present invention can also be used in vending machines and pay point machines, where customers have the option to pay with a combination of currency and tickets. For purposes of detailing the invention, the description herein is tailored to the application of the invention in a gaming machine.

Casinos are introducing tickets into circulation as a substitute for currency within the casino. The tickets should be acceptable to the note discriminator 14 of gaming machines to allow a player to obtain credits on various gaming machines without the use or transfer of paper currency. To ensure that the introduction of tickets does not interfere with the currency counting and sorting functions conducted in the counting rooms, the gaming machines having the bill acceptor 10 are able to both validate tickets and currency and separate the tickets from the currency.

Figure 2:
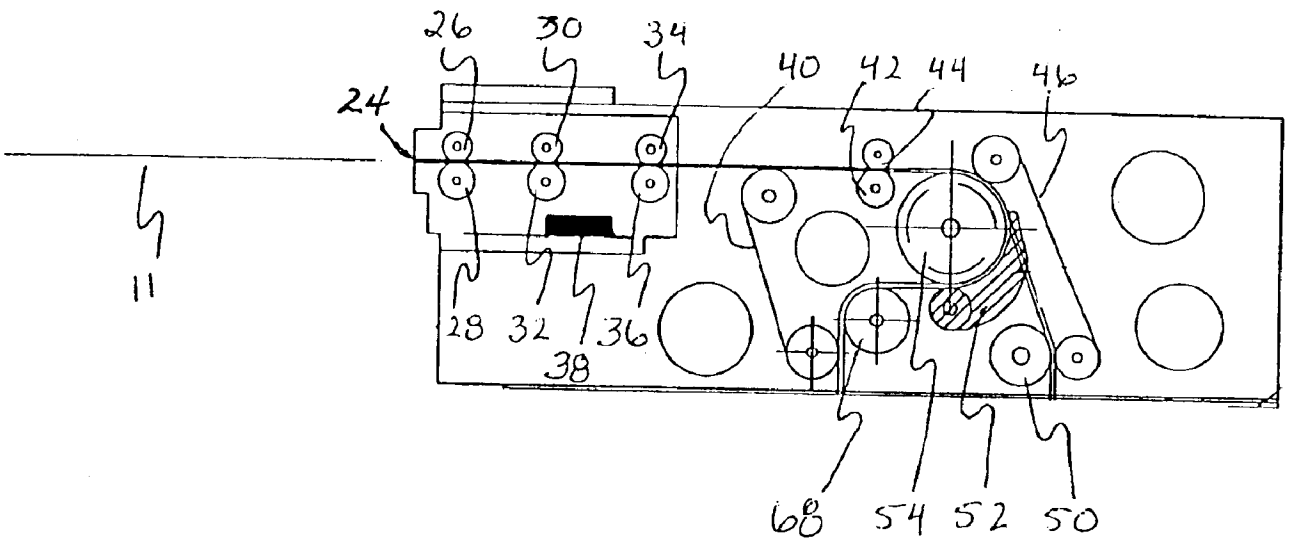
FIG. 2 is a cross-sectional view of the validator assembly portion of the bill acceptor of FIG. 1.

As illustrated in FIG. 2, the bill acceptor 10 is intended to sequentially receive a note 11, which can be either a ticket or a bill, into the note discriminator 14 to initiate play of the gaming machine (not shown). The note discriminator 14 scans each note 11 inserted into an opening 24 of the note discriminator 14 to determine the authenticity, type (legal tender or ticket), denomination and condition (whether the note is worn) of the note 11. Once the note 11 is inserted into the opening 24 of the discriminator 14, rollers 26 and 28 draw the 11 into the note discriminator 14. Then rollers 30, 32 and rollers 34, 36, each acting in parity with one another, further draw the note 11 past various sensors (not shown) to examine and validate the note 11. As the note 11 is captured and transported past the optical and magnetic sensors, the sensors typically sense light reflected by and/or transmitted through the note 11, reflectivity and transmission patterns, size of the note 11 and the magnetic characteristics of the inserted note 11.

Inside the note discriminator 14, the sensors provide signals to a circuit board mounted validator processor 38 which is also connected to the processor of the gaming machine. In addition, the validator processor 38 has various processing capabilities which are known in the art. The various sensors output sensed data output signals, which are compared by the validator processor 38 to stored data representative of the range of sensor readings corresponding to authentic notes. A note is determined valid and authentic based on the comparison with the stored data for authentic notes. If the note is not determined valid, the drive assembly of the note discriminator 14 is reversed and the note is ejected through the opening 24 to the customer. If the note 11 is determined valid, it is passed through the note discriminator 14 and directed to the transportation assembly 16. Upon receipt of a note 11 and determination of validity, a signal is sent to the host or gaming machine processor (not shown) signifying receipt as well as the denomination of the note for accumulation of a like value amount of credits in the gaming machine for gaming.

The transportation assembly 16 and the note discriminator 14 are electrically connected so that the note discriminator 14 can instruct the transportation assembly 16 to operate to transport the note 11. The transportation assembly 16 can direct the note into either a bill hopper 20 or a ticket hopper 22 of the dual section cash box 18. The transportation assembly 16 includes a deflector 52, controlled by the note discriminator 14, to select which hopper is appropriate.

Figure 4:
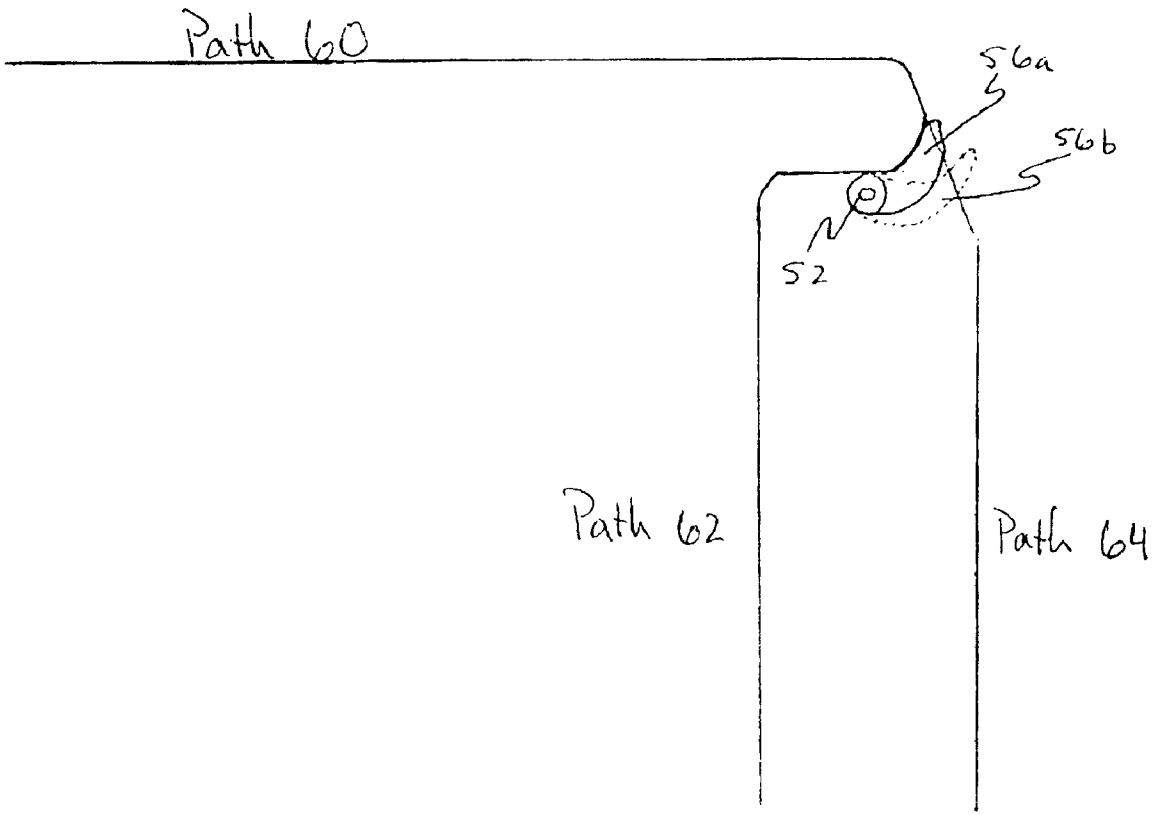
FIG. 4 is a diagram illustrating the flow and direction of an accepted note or ticket through the validator and into the cash box.

As shown in FIG. 2 and FIG. 4, if the note 11 meets all of the validation criteria, the note 11 proceeds to a drive belt 40 of the transportation assembly 16. The note 11, due to frictional forces, stays on the drive belt 40 through rollers 42 and 44. A motor (not shown) powers the drive belt 40 and a drive belt 46. The drive belt 40 and the drive belt 46 tangentially touch one another along an idler wheel 54. The note 11 has, so far, followed a path 60 from the opening 24 to the transportation assembly 16. The note 11 then enters a meeting point of the drive belt 40 and the drive belt 46 before the note 11 is deflected by a deflector 52. The deflector 52 selectively directs the note 11 from the path 60 onto either a path 62 or a path 64. The path 62 leads to the bill hopper 20, whereas the path 64 terminates in the ticket hopper 22.

A decision by the note discriminator 14 that the note 11 is a valid ticket will cause the deflector 52 to move into a closed position 56*a*. The deflector 52 will peel the note 11 from the drive belt 20 and send the note 11 along the drive belt 46, wherein the note 11 will follow the path 64 as seen in FIG. 4. The note 11 will travel along the drive belt 46 and pass a roller 50 from which the note 11 is guided into the ticket hopper 22. If the note discriminator 14 decides the note 11 is valid currency, the deflector 52 will remain in an open position 56*b*, wherein the note 11 will continue along the drive belt 46 on the path 62. The note 11 will first travel horizontally and then vertically down on the path 62 until the note 11 is directed past a roller 68 and into the bill hopper 20, as illustrated in FIGS. 2, 3, and 4.

Figure 3:
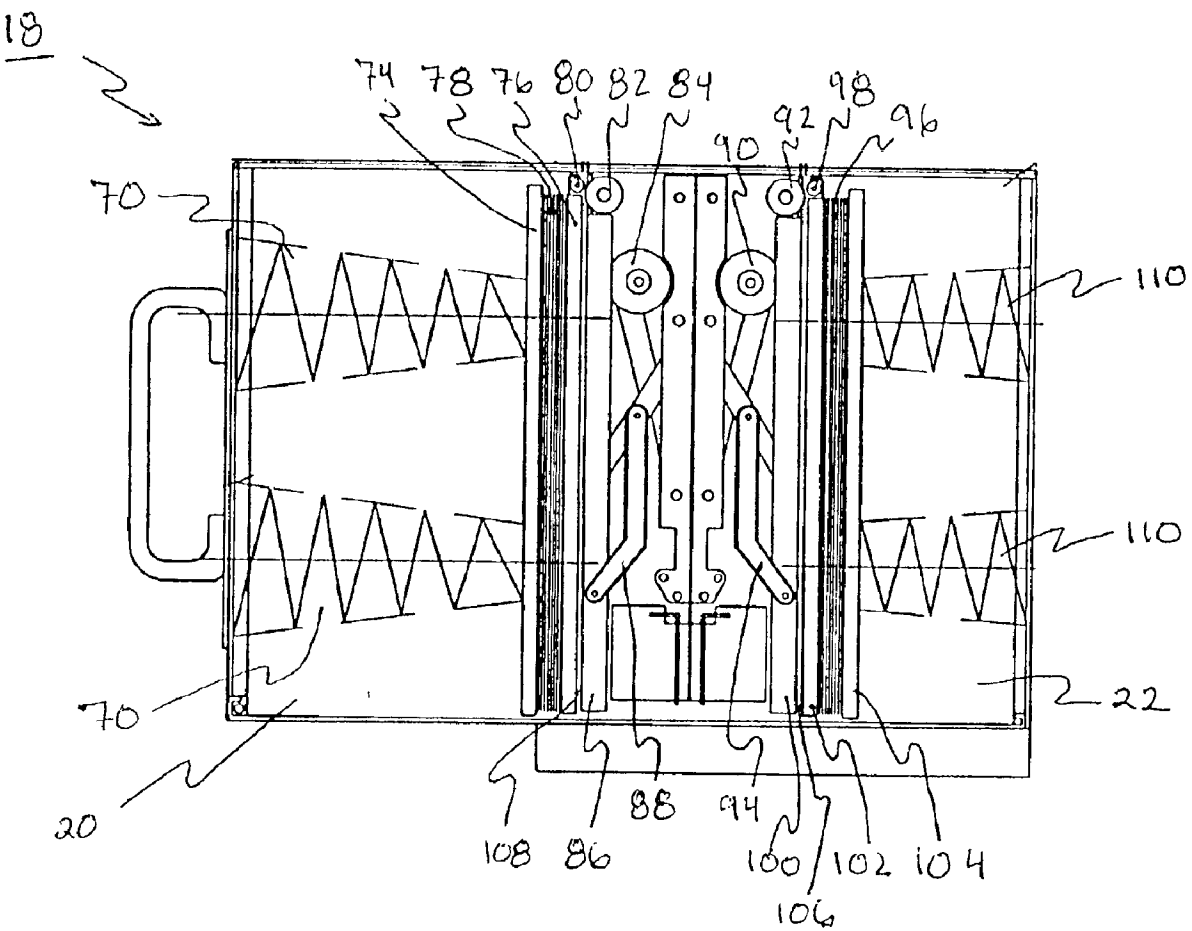
FIG. 3 is a cross-sectional view of a dual section cash box with a bill hopper and a ticket hopper for the bill acceptor of FIG. 1.

As depicted in FIG. 3, the note 11, if it is currency, enters the bill hopper 20 through rollers 80 and 82. Either side of the cash box 18 can be used for currency, but the note discriminator 14 and the transportation assembly 16 have to be programmed accordingly. FIG. 3 shows one embodiment, wherein the bill hopper 20 is situated on the front side of the cash box 18 proximate the handle 72 and the ticket hopper 22 is on the rear side of the cash box 18.

To store the note 11 in the bill hopper 20, the note 11 is guided into a placer area 108 created between plates 76 and 86. The note stays in the placer area 108 until it is moved into a stacker area 78. Once the note 11 is within the placer area 108, a drive wheel 84 and cantilever arm 88 operate to push plate 86 through an opening (not shown) in plate 76, which transports the bill from the placer area 108 into the stacker area 78. As the number of bills in the stacker area 78 increases, the plate 76 pushes the stacked notes against a plate 74 and against springs 70 to create additional storage space. Springs 70 are connected to the cash box 18 on one end and to the plate 74 on the other end.

The ticket hopper 22 works in an identical manner as the bill hopper 20. The note 11, if deemed a ticket, is directed by rollers 92 and 98 into a placer area 106, where the ticket is held until it is moved into a stacker area 96. Once a ticket is within the placer area 106, a drive wheel 90 and cantilever arm 94 push a plate 100 through an opening (not shown) in a plate 102. This forces the ticket in the placer area 106 into the stacker area 96. The stacked tickets and the plate 104 move away from the plate 102 to accommodate the new ticket, and the plate 104 pushes back on springs 70 to create additional storage space. Springs 110 are connected to the cash box 18 on one end and to the plate 104 on the other end.

To remove and transport the cash box 18 from its position in FIG. 1, an authorized person must first unlock the cash box 18 and then pull on a handle 72. To allow for secure removal, the cash box 18 should preferably have a secure lid enclosing the cash box 18 with two slits big enough for notes to enter each hopper. This lid should have a second locking mechanism so that access to the contents can be controlled and limited to those with proper authorization. After a filled cash box 18 is removed, an empty cash box 18 can be put into its former position. The bill acceptor 10 may include sensors and mechanisms to recognize whether the replacement cash box 18 has been preauthorized to accept currency and tickets. This security feature ensures that only authorized cash boxes with the proper security mechanisms are being used.

The filled cash box 18 is then taken to the counting room after the cash box 18 has been removed from the gaming machine. The cash box 18 may also have flash memory that can store exactly how many notes entered the cash box 18 while the cash box 18 was in use inside the gaming machine. When the cash box 18 is emptied into the counting and sorting machine, the information in the flash memory should be downloaded to a computer and compared with the actual number of notes that exited from the cash box 18 into the counting and sorting machines. This redundant system will help ensure accuracy in the counting process.

As can be appreciated, the dual section cash box note and ticket validator and the method of the present invention provide several benefits. One benefit is that it increases the efficiency of the counting and sorting functions carried on in the counting rooms to keep accurate accounts of the money flowing in and out of the individual gaming machines. Whereas in previous devices the cashbox stacked tickets with currency, the tickets are now stored in a separate compartment, allowing easy separation of the tickets. Another advantage is that casinos can easily increase the number of tickets in their circulation of currency without slowing down any other function, which in turn decreases the amount of cash transported into and out of the casino floor. As another advantage, the cash box can be configured to hold all tickets or all currency. In addition, the casino can alter which compartment holds tickets and which one holds currency.

The present invention can also be used for various vending machines where tickets are available in lieu of currency. For example, at a theme park, a customer could purchase tickets using a credit card and use the tickets in vending machines in the park. This would save the customer the many surcharges and dangers often associated with withdrawing and carrying currency from ATM machines.

As an example of an alternative embodiment of the contemplated invention which would be readily apparent to those skilled in the art following review of the foregoing detailed description, the stacking of the notes can be changed to accommodate varying usages of tickets and currency. In the present embodiment, notes enter vertically into the placer areas 78 and 96. Other embodiments can include a horizontal stacking of notes, vertical stacking of tickets; horizontal stacking of notes and tickets, one above the other; and vertical stacking of notes and tickets, one behind the other. These arrangements may have the benefit of maximizing the utilization of space within the cash box and minimizing the number of times the cash box has to be emptied and replaced.

Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A bill acceptor comprising:

a validator assembly capable of identifying acceptable notes and discriminating between currency and non-currency notes;

a dual section cash box configured to receive and hold notes received by said bill acceptor, said dual section cash box having a first hopper for receiving currency and a second hopper for receiving non-currency notes; and a transport assembly connected to and controlled by said validator assembly for transporting currency from said validator assembly to said first hopper of said cash box and non-currency notes from said validator assembly to said second hopper.

2. The bill acceptor of claim 1, wherein the validator accepts non-currency notes including bills, vouchers, script, and tickets and provides a control signal to said transport assembly to activate a deflector to direct said non-currency notes to said second hopper.

3. The bill acceptor of claim 1, wherein the validator assembly further comprises:

a note discriminator to sense parameters of received notes and determine the authenticity of said received notes.

4. The bill acceptor of claim 1, further comprising:

a note discriminator having an opening for receiving notes and a validator head including means for sensing data relating to the authenticity, denomination, and type of note inserted into said discriminator and for generating signals corresponding to the sensed data for each received note.

5. The bill acceptor of claim 1, wherein said transport assembly further comprises:

a deflector for directing notes determined to be authentic non-currency notes to said second hopper of said cash box in response to a signal received from said validator assembly.

6. The bill acceptor of claim 1, wherein said dual section cash box further comprises:

at least one placer and a stacker within said first hopper.

7. The bill acceptor of claim 1, wherein said dual section cash box further comprises:

at least one placer and a stacker within said second hopper.

8. The bill acceptor of claim 1, wherein said dual section cash box further comprises:

at least two separate sections configured to store notes in stacked orientations; and a placer assembly within each of said at least two separate sections for receiving individual notes and subsequently placing said received notes on a stack of received notes.

9. A bill acceptor comprising:

a validator assembly capable of identifying acceptable notes and discriminating between currency and non-currency notes, said validator assembly including a note discriminator to sense parameters of received notes and determine authenticity of received notes;

a dual section cash box configured to receive and hold notes received by said bill acceptor, said dual section cash box having a first hopper for receiving currency and a second hopper for receiving non-currency notes;

a transport assembly connected to and controlled by said validator assembly for transporting currency from said validator assembly to said first hopper of said cash box and non-currency notes from said validator assembly to said second hopper; and a deflector integrated into said transport assembly and connected to said validator assembly, said deflector directing notes determined to be authentic non-currency notes to said second hopper of said cash box in response to a signal received from said validator assembly.

10. A method of separating and stacking currency and non-currency notes received by a bill acceptor, comprising:

providing a validator assembly capable of identifying acceptable notes and discriminating between currency and non-currency notes using a validator assembly; and directing acceptable notes to a transport assembly connected to and controlled by said validator assembly for transporting notes from said validator assembly to a dual section cash box configured to receive and hold notes received by said bill acceptor, said dual section cash box having a first hopper for receiving currency directed to said first hopper by said transport assembly and a second hopper for receiving non-currency notes directed to said second hopper by said transport assembly.

11. The method of claim 10, wherein the dual section cash box includes a secure lid having a first slit communicating with said first hopper and a second slit communicating with said second hopper, and the transporting includes transporting currency into the first slit and transporting non-currency notes into the second slit.

12. The method of claim 10, further comprising unlocking the dual section cash box after it is filled, pulling the unlocked box away from the bill acceptor, transporting the box to a counting room, and unlocking the box at the counting room.

13. A bill acceptor comprising:

discriminating means for discriminating between currency and non-currency notes;

a dual-section cash box including a first hopper and a second hopper;

transporting means operatively associated with the discriminating means for transporting currency notes as discriminated by the discriminating means to the first hopper and for transporting non-currency notes as discriminated by the discriminating means to the second hopper;

wherein the transporting means includes a note transport first path to the first hopper and a note transport second path to the second hopper; and wherein the transporting means includes a deflector for controlling whether the transporting means transports a note from the discriminating means along the first path or the second path.

14. The bill acceptor of claim 13, wherein the discriminating means generates a signal for determining the position of the deflector.

15. The bill acceptor of claim 13, wherein the deflector is controlled by the discriminating means.

16. A bill acceptor comprising:

discriminating means for discriminating between currency and non-currency notes;

a dual-section cash box including a first hopper and a second hopper;

transporting means operatively associated with the discriminating means for transporting currency notes as discriminated by the discriminating means to the first hopper and for transporting non-currency notes as discriminated by the discriminating means to the second hopper; and wherein the discriminating means is adapted to send an operative signal to a processor of a gaming machine.

17. The bill acceptor of claim 16, wherein the discriminating means determines whether received notes are acceptable notes.

18. The bill acceptor of claim 16, wherein the non-currency notes include tickets.

19. The bill acceptor of claim 16, wherein the non-currency notes include bills, vouchers, script and tickets.

20. The bill acceptor of claim 16, wherein the discriminating means includes a note discriminator to sense parameters of received notes and thereby determine authenticity thereof.

21. A bill acceptor comprising:

discriminating means for discriminating between currency and non-currency notes;

a dual-section cash box including a first hopper and a second hopper;

transporting means operatively associated with the discriminating means for transporting currency notes as discriminated by the discriminating means to the first hopper and for transporting non-currency notes as discriminated by the discriminating means to the second hopper; and at least one placer and a stacker within the second hopper.

22. The bill acceptor of claim 21, further comprising at least one placer and a stacker within the first hopper.

23. The bill acceptor of claim 20, wherein the discriminating means sends a counter signal to a processor of a gaming machine.

24. A bill acceptor comprising:

discriminating means for discriminating between currency and non-currency notes;

a removable cash box having at least a first hopper and a second hopper;

transporting means operatively associated with the discriminating means for transporting currency notes as discriminated by the discriminating means to the first hopper and for transporting non-currency notes as discriminated by the discriminating means to the second hopper; and wherein the discriminating means sends a signal to a note deflector of the transporting means to determine whether the transporting means transports a note to the first or second hopper.

25. A bill acceptor comprising:

discriminating means for discriminating between currency and non-currency notes;

a removable cash box having at least a first hopper and a second hopper; and transporting means operatively associated with the discriminating means for transporting currency notes as discriminated by the discriminating means to the first hopper and for transporting non-currency notes as discriminated by the discriminating means to the second hopper; and wherein the transporting means transports non-currency notes to a placer area defined between first and second plates and subsequently from the placer area to a stacker area.

26. The bill acceptor of claim 25, wherein when a non-currency note is in the placer area the first plate is pushed through an opening in the second plate to transport the non-currency note in the placer area into the stacker area.

27. The bill acceptor of claim 26, wherein the second plate as the number of non-currency notes stacked in the stacker area increases, pushes the stacker notes against a spring-loaded third plate to create additional note storage space.

28. A bill acceptor comprising:

discriminating means for discriminating between currency and non-currency notes;

a first hopper;

a second hopper; and transporting means operatively associated with the discriminating means for transporting currency notes as discriminated by the discriminating means to the first hopper and for transporting non-currency notes as discriminated by the discriminating means to the second hopper;

wherein the first and second hoppers form at least in substantial part a dual-section cash box, and within each of the hoppers is a placer assembly which receives individual notes and subsequently places the received notes on a stack of received notes.

29. The bill acceptor of claim 28, wherein the discriminating means sends a signal to a processor of a gaming machine.

30. A bill acceptor comprising:

a validator assembly adapted to identify acceptable notes and discriminate between currency and non-currency notes;

a first hopper adapted to receive and hold acceptable currency notes from the validator assembly;

a second hopper adapted to receive and hold acceptable non-currency notes from the validator assembly; and a transport assembly connected to and controlled by the validator assembly and adapted to transport acceptable currency notes from the validator assembly to the first hopper and acceptable non-currency notes from the validator assembly to the second hopper;

wherein the first and second hoppers form at least in substantial part a dual-section cash box.

31. A bill acceptor comprising:

a validator assembly adapted to identify acceptable notes and discriminate between currency and non-currency notes;

a first hopper adapted to receive and hold acceptable currency notes from the validator assembly;

a second hopper adapted to receive and hold acceptable non-currency notes from the validator assembly; and a transport assembly connected to and controlled by the validator assembly and adapted to transport acceptable currency notes from the validator assembly to the first hopper and acceptable non-currency notes from the validator assembly to the second hopper;

wherein the validator assembly is adapted to send a signal relative to the acceptable notes identified to a processor of a gaming machine.

32. A bill acceptor comprising:

a validator assembly adapted to identify acceptable notes and discriminate between currency and non-currency notes;

a cash box having at least a first hopper adapted to receive and hold acceptable currency notes from the validator assembly and a second hopper adapted to receive and hold acceptable non-currency notes from the validator assembly; and a transport assembly connected to and controlled by the validator assembly and adapted to transport acceptable currency notes from the validator assembly to the first hopper and acceptable non-currency notes from the validator assembly to the second hopper;

wherein within each of the hoppers is a placer assembly which receives individual notes and subsequently places the received notes on a stack of previously received notes.

33. A bill acceptor comprising:

a validator assembly adapted to identify acceptable notes and discriminate between currency notes and non-currency, casino-gaming ticket notes;

a removable dual-section cash box adapted to receive and hold the notes received by the bill acceptor, the dual-section cash box having a first hopper for receiving currency notes and a second hopper for receiving non-currency, casino-gaming ticket notes;

a transport assembly connected to and controlled by the validator assembly for transporting currency notes from the validator assembly to the first hopper and non-currency, casino-gaming ticket notes from the validator assembly to the second hopper; and the validator assembly being further adapted to send a signal to both interface with a processor of a casino gaming machine signifying receipt and denomination of the currency notes and non-currency, casino-gaming ticket notes for accumulation of a like value amount of gaming credits in the gaming machine and with the transport assembly to guide the notes to the first or second hoppers depending on whether they are determined by the validator assembly to be acceptable currency notes or acceptable non-currency casino-gaming ticket notes.

34. The bill acceptor of claim 33, wherein the transporting assembly transports non-currency, casino-gaming ticket notes to a placer area defined between first and second plates and subsequently from the placer area to a stacker area.

35. The bill acceptor of claim 34, wherein when a non-currency, casino-gaming ticket note is in the placer area, the first plate is pushed through an opening in the second plate to transport the non-currency, casino-gaming note in the placer area into the stacker area.

36. The bill acceptor of claim 35, wherein the second plate, as the number of non-currency casino-gaming notes stacked in the stacker area increases, pushes the stacker notes against a spring-loaded third plate to create additional note storage space.

* * * * *